US005396206A

United States Patent [19]

Herd et al.

[11] Patent Number: 5,396,206

[45] Date of Patent: Mar. 7, 1995

[54] SUPERCONDUCTING LEAD ASSEMBLY FOR A CRYOCOOLER-COOLED SUPERCONDUCTING MAGNET

[75] Inventors: Kenneth G. Herd, Niskayuna; Evangelos T. Laskaris, Schenectady; Paul S. Thompson, Stephentown, all of N.Y.

[73] Assignee: General Electric Company, Schenectady, N.Y.

[21] Appl. No.: 209,287

[22] Filed: Mar. 14, 1994

[51] Int. Cl.[6] ..... H01F 7/22

[52] U.S. Cl. ..... 505/163; 174/125.1; 62/51.1; 505/844; 505/879; 505/893; 505/211; 335/216

[58] Field of Search ..... 335/216; 336/DIG. 1; 174/15.4, 15.5, 125.1; 62/51.1; 505/1, 700, 704–706, 844, 879, 880, 884–888, 892, 893

[56] References Cited

U.S. PATENT DOCUMENTS

| | | | |
|---|---|---|---|
| 4,876,413 | 10/1989 | Vermilyea . | |
| 4,895,831 | 1/1990 | Laskaris . | |
| 4,926,647 | 5/1990 | Dorri et al. . | |
| 4,930,318 | 6/1990 | Brzozowski . | |
| 5,111,665 | 5/1992 | Ackermann . | |
| 5,166,776 | 11/1992 | Dederer et al. | 62/51.1 |
| 5,260,266 | 11/1993 | Herd et al. . | |
| 5,298,679 | 3/1994 | Wu et al. | 174/15.4 |

OTHER PUBLICATIONS

"Grain-Aligned YBCO Superconducting Current Leads for Conduction-Cooled Applications", by K. G. Herd et al., IEEE Transactions on Applied Superconductivity, vol. 3., No. 1, Mar. 1993.

"Cold Head Sleeve and High-Tc Superconducting Lead Assemblies for a Superconducting Magnet which Images Human Limbs", Laskaris et al., U.S. application Ser. No. 08/000,303, filed Jan. 4, 1993.

*Primary Examiner*—Leo P. Picard
*Assistant Examiner*—Raymond M. Barrera
*Attorney, Agent, or Firm*—Douglas E. Erickson; Paul R. Webb, II

[57] ABSTRACT

A superconducting magnet lead assembly for a cryocooler-cooled superconducting magnet having a design current of between generally 50 and 250 amperes. A DBCO (Dysprosium Barium Copper Oxide), YBCO (Yttrium Barium Copper Oxide), or BSCCO (Bismuth Strontium Calcium Copper Oxide) superconducting lead has its ends flexibly, dielectrically, and thermally connected, one end to the generally 30 to 50 Kelvin first stage and the other end to the generally 8 to 30 Kelvin second stage of the cryocooler coldhead. The superconducting lead has a generally constant cross-sectional area along its length. The design current, the lead's length, and the lead's cross-sectional area are chosen such that the design current times the lead's length divided by the lead's cross-sectional area is between generally 720 and 880 amperes per centimeter for a DBCO or YBCO lead and is between generally 180 and 220 amperes per centimeter for a BSCCO lead. The superconducting lead will not itself precipitate a magnet quench (i.e., the superconducting lead does not conduct significant heat between the coldhead stages during the superconductive mode), and the superconducting lead will survive a lead quench from other causes (i.e., the superconducting lead does conduct the resistive heat buildup to the coldhead stages during a lead quench) and thus be acceptable for commercial applications.

15 Claims, 1 Drawing Sheet

SUPERCONDUCTING LEAD ASSEMBLY FOR A CRYOCOOLER-COOLED SUPERCONDUCTING MAGNET

BACKGROUND OF THE INVENTION

The present invention relates generally to a cryocooler-cooled superconductive magnet, and more particularly to such a magnet having a superconducting lead assembly which is flexibly, dielectrically, and thermally connected to the first and second stages of the cryocooler coldhead.

Superconducting magnets may be used for various purposes, such as to generate a uniform magnetic field as part of a magnetic resonance imaging (MRI) diagnostic system. MRI systems employing superconductive magnets are used in various fields such as medical diagnostics. Known designs include cryocooler-cooled superconductive magnets wherein the cryocooler coldhead has a first stage with a design temperature between generally 40 and 50 Kelvin and a second stage with a design temperature between generally 8 and 20 Kelvin. The superconducting coil assembly of the superconducting magnet has its magnet cartridge thermally connected to the coldhead's second stage. A non-superconducting lead assembly has its two non-superconducting lead wires each with one end electrically connected to an electric current source and each with the other end thermally and dielectrically connected to the coldhead's first stage. A superconducting lead assembly has its two superconducting leads each with one end flexibly, dielectrically, and thermally connected to the coldhead's first stage and with the other end flexibly, dielectrically, and thermally connected to the coldhead's second stage. Each superconducting lead is electrically connected to its corresponding non-superconducting lead at the coldhead's first stage. Known superconducting leads include DBCO (Dysprosium Barium Copper Oxide), YBCO (Yttrium Barium Copper Oxide), and BSCCO (Bismuth Strontium Calcium Copper Oxide) superconducting leads. A superconducting lead would have its cross-sectional area large enough such that at the design current, the superconducting lead's current density would be lower than the critical current density of the superconducting lead material at a temperature equal to the coldhead's first stage design temperature and for the stray magnetic field strength it would experience from the superconducting magnet.

It is known that cryocooler performance may degrade over time. The resulting increase in temperature of the second stage will quench the superconducting wire of the superconducting coil assembly, and the resulting increase in temperature of the first stage will quench the superconducting leads of the superconducting lead assembly. Upon quenching (i.e., loss of superconductivity), the design current thereafter will flow in a non-superconducting manner in the magnet and will generate resistive heating that will destroy the superconducting wire of the superconducting coil assembly and the superconducting leads of the superconducting lead assembly. It is known to protect the superconducting wire of the superconducting coil assembly by adding a copper stabilizer wire in parallel with the superconducting wire such that, upon quenching, the current will flow through the stabilizer wire and not destroy (i.e., burnout) the superconducting wire. Simply adding a copper stabilizer wire to the superconducting leads of the superconducting lead assembly to prevent their destruction upon quenching is not a solution because of the unacceptable heat conduction that would occur in the superconducting mode along the stabilizer wire from its connections to the first and second stages of the cryocooler coldhead.

Until Applicants' invention, it was not considered possible to operate a cryocooler-cooled superconducting magnet with superconducting leads connected between the first and second stages of the cryocooler coldhead without risking the destruction (i.e., burnout) of the superconducting leads in the event of a lead quench.

What is needed is a superconducting lead assembly for a cryocooler-cooled superconducting magnet that will not be destroyed by resistive heating in the event of a lead quench.

SUMMARY OF THE INVENTION

It is an object of the invention to provide a superconducting lead assembly, for a cryocooler-cooled superconducting magnet, that is protected against burnout in the event of a lead quench.

The superconducting lead assembly of the present invention is used in a cryocooler-cooled superconducting magnet having a design current between about 50 and 250 amperes and having cryocooler coldhead design temperatures between about 30 and 50 Kelvin for the coldhead's first stage and between about 8 and 30 Kelvin for the coldhead's second stage. The superconducting lead assembly includes a DBCO (Dysprosium Barium Copper Oxide), YBCO (Yttrium Barium Copper Oxide), or BSCCO (Bismuth Strontium Calcium Copper Oxide) superconducting lead having its ends flexibly, dielectrically, and thermally connected, one end to the coldhead's first stage and the other end to the coldhead's second stage. The superconducting lead has a generally constant cross-sectional area along its length. The design current times the lead's length divided by the lead's cross-sectional area is between generally 720 and 880 amperes per centimeter for a DBCO or YBCO lead and is between generally 180 and 220 amperes per centimeter for a BSCCO lead.

Several benefits and advantages are derived from the invention. Selecting a design current, a lead length, and a lead cross-sectional area such that the design current times the lead's length divided by the lead's cross-sectional area is between generally 720 and 880 amperes per centimeter for a DBCO or YBCO lead and is between 180 and 220 amperes per centimeter for a BSCCO lead yields a DBCO, YBCO, or BSCCO superconducting lead which conducts heat between the first and second stage cryocooler coldhead such that the heat conduction is small enough not to precipitate excessive magnet heating when the lead is operating in a superconducting mode during normal magnet operation and such that the heat conduction is large enough to protect the superconducting lead from being destroyed by resistive heating when the lead is operating in a non-superconducting mode during a lead quench. It was Applicants who first discovered, in their research and development work, that it was possible to so design the superconducting leads to be protected against burnout when operating in a non-superconducting mode during a lead quench, while not having the superconducting leads precipitate excessive magnet heating when operating in a superconducting mode during normal magnet operation. This heretofore was not recognized in the prior art, and prior art superconducting leads were not heretofore considered for actual inclusion in commercial conduction-cooled superconducting magnets where destruction of the superconducting leads during a lead quench was to be avoided.

BRIEF DESCRIPTION OF THE DRAWINGS

The accompanying drawings illustrate a preferred embodiment of the present invention wherein.

DETAILED DESCRIPTION OF THE INVENTION

Figure 1:
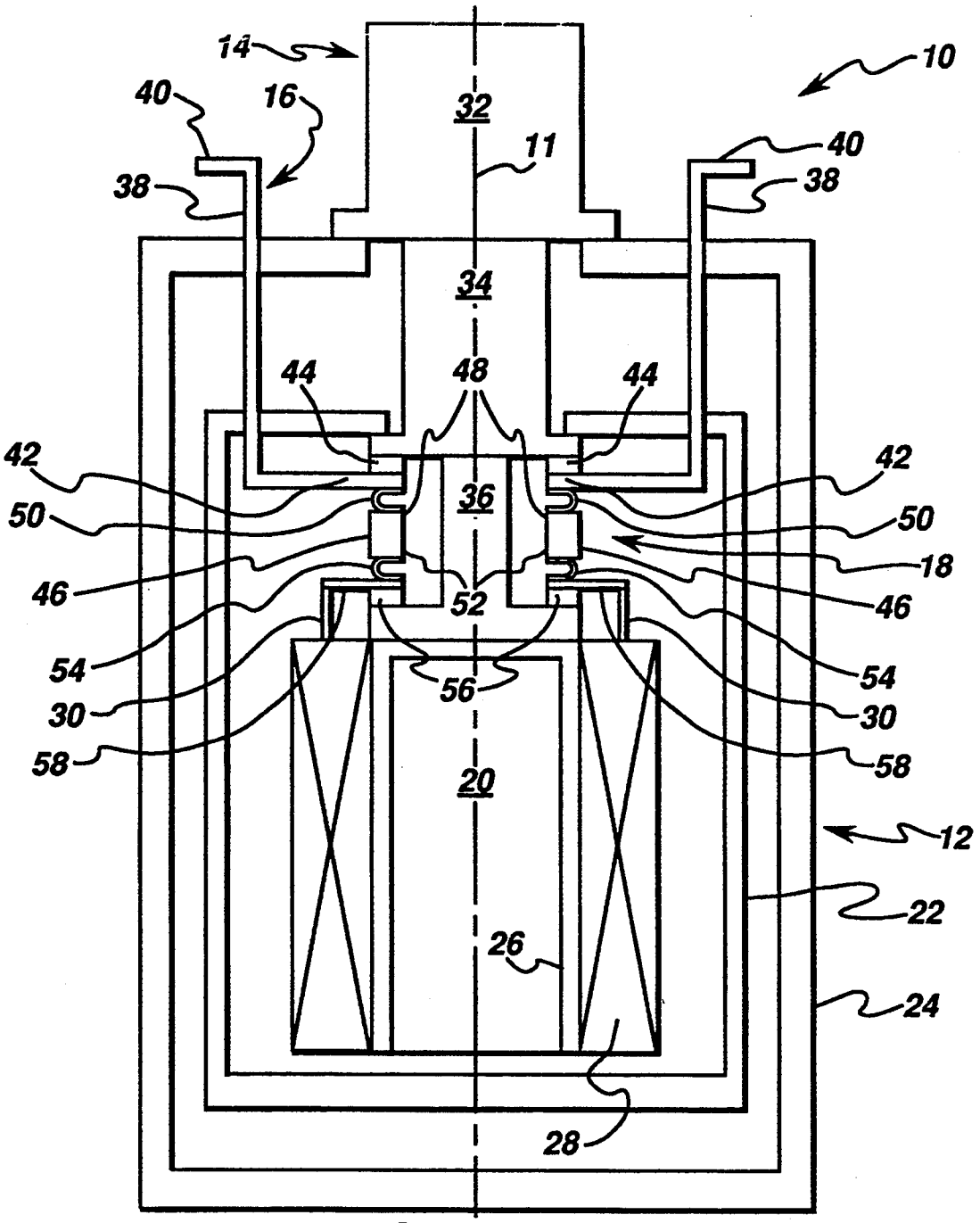
FIG. 1 is a schematic side elevational view of a cryocooler-cooled superconducting magnet employing the superconducting lead assembly of the present invention.

Referring now to the drawings, wherein like numerals represent like elements throughout, FIG. 1 shows a superconducting magnet 10 which includes a centerline 11, a superconducting coil assembly 12, a cryocooler coldhead 14, a non-superconducting lead assembly 16, and the superconducting lead assembly 18 of the present invention. The superconducting magnet 10 has a design current between generally 50 and 250 amperes.

The superconducting coil assembly 12 includes a magnet cartridge 20 surrounded by a spaced-apart thermal shield 22 surrounded by a spaced-apart vacuum enclosure 24. The magnet cartridge 20 includes a coil form 26 and a superconducting wire 28 wound thereon. The superconducting wire 28 has two ends 30 and may be a niobium-tin superconducting wire.

The superconducting magnet 10 is cooled by the cryocooler coldhead 14. The cryocooler coldhead 14 (such as that of a conventional Gifford-McMahon cryocooler) includes: a housing 32 which is hermetically connected to the room-temperature vacuum enclosure 24; a first stage 34 which is thermally connected to the thermal shield 22 and which has a first stage design temperature of between generally 30 and 50 Kelvin; and a second stage 36 which is thermally connected to the coil form 26 of the magnet cartridge 20 and which has a second stage design temperature of between generally 8 and 30 Kelvin.

The non-superconducting lead assembly 16 includes two non-superconducting lead wires 38 which preferably are made of OFHC (oxygen-free hard copper) copper. Each non-superconducting lead wire 38 hermetically passes through the vacuum enclosure 24 and passes through the thermal shield 22. Each non-superconducting lead wire 38 has two ends 40 and 42. End 40 is disposed outside the vacuum enclosure 24 and is electrically connected to a source of electric current (not shown), and end 42 is disposed inside the thermal shield 22 and is thermally and dielectrically connected to the first stage 34 of the cryocooler coldhead 14 via dielectric interfaces 44.

Figure 2:
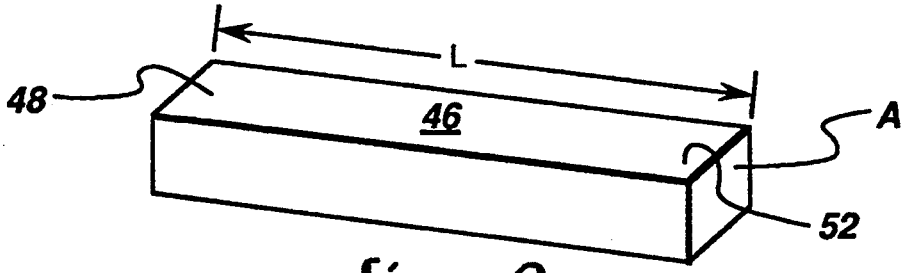
FIG. 2 is an enlarged perspective view of a superconducting lead of the superconducting lead assembly employed in FIG. 1.

The superconducting lead assembly 18 for the superconducting magnet 10 includes two superconducting leads 46. Each superconducting lead 46 is a polycrystalline sintered ceramic superconducting lead and may be a DBCO (Dysprosium Barium Copper Oxide), YBCO (Yttrium Barium Copper Oxide), or BSCCO (Bismuth Strontium Calcium Copper Oxide) superconducting lead. Preferably, each superconducting lead 46 is a grain-aligned DBCO, a grain-aligned YBCO, or a grain-aligned BSCCO superconducting lead. Grain alignment is preferred because it improves the performance of the lead in a stray magnetic field. As seen from FIG. 2, the superconducting lead 46 has a length L and a cross-sectional area A which is generally constant along its length L. The cross-sectional area A may be rectangular, as shown in FIG. 2, or it may have any other shape.

Each superconducting lead 46 has a first end 48 which is flexibly, dielectrically, and thermally connected to the first stage 34 of the cryocooler coldhead 14 via flexible thermal busbar 50 and dielectric interface 44. Each superconducting lead 46 has a second end 52 which is flexibly, dielectrically, and thermally connected to the second stage 36 of the cryocooler coldhead 14 via flexible thermal busbar 54 and dielectric interface 56. The flexible thermal busbars 50 and 54 may be made of laminated OFHC copper, and the dielectric interfaces 44 and 56 may be made of nickel-plated beryllia chips. First end 48 is also electrically and abuttingly connected to end 42 of the non-superconducting lead wire 38, and second end 52 is also electrically connected to one of the ends 30 of the superconducting wire 28 of the superconducting coil assembly 12 via rigid busbar 58 which may be made of OFHC copper. Silver pads (not shown) may be sintered onto the first end 48 and the second end 52. All previously-mentioned connections may be made using conventional soldering.

For a DBCO or YBCO superconducting lead 46, the design current, the lead's length, and the lead's cross-sectional area are chosen such that the design current times the lead's length divided by the lead's cross-sectional area is equal generally to within ten percent of an optimum ratio. Applicants have determined that optimum ratio, from analysis and experiment, to be 800 amperes per centimeter in order that the superconducting lead 46 will not conduct excessive heat between the coldhead stages during superconductive operation so as to precipitate a magnet quench and in order that the superconducting lead 46 will conduct resistive heat buildup to the coldhead stages during non-superconductive operation so as to survive a lead quench. Thus, the design current times the lead's length divided by the lead's cross-sectional area is between generally 720 and 880 amperes per centimeter and preferably is generally 800 amperes per centimeter. For example, a preferred design current is generally 100 amperes, and a preferred value of the lead's length divided by the lead's cross-sectional area is generally 8 inverse centimeters.

For a BSCCO superconducting lead 46, the design current, the lead's length, and the lead's cross-sectional area are chosen such that the design current times the lead's length divided by the lead's cross-sectional area is equal generally to within ten percent of an optimum ratio. Applicants have determined that optimum ratio, from analysis, to be 200 amperes per centimeter in order that the superconducting lead 46 will not conduct excessive heat between the coldhead stages during superconductive operation so as to precipitate a magnet quench and in order that the superconducting lead 46 will conduct resistive heat buildup to the coldhead stages during non-superconductive operation so as to survive a lead quench. Thus, the design current times the lead's length divided by the lead's cross-sectional area is between generally 180 and 220 amperes per centimeter and preferably is generally 200 amperes per centimeter. For example, a preferred design current is generally 100 amperes, and a preferred value of the lead's length divided by the lead's cross-sectional area is generally 2 inverse centimeters. It is noted that a BSCCO lead would conduct more heat between the coldhead stages than would a DBCO or YBCO lead during superconductive operation.

In operation, during the normal superconductive mode of magnet operation, electric current flows: non-superconductively in the non-superconducting lead wires 38 and flexible thermal busbars 50; then superconductively in the superconducting leads 46; then non-superconductively in the flexible thermal busbars 54 and rigid busbars 58; and then superconductively in the superconducting wire 28 of the superconducting coil assembly 12. With the design current, the lead's length, and the lead's cross-sectional area chosen such that the design current times the lead's length divided by the lead's cross-sectional area is generally equal to 800 amperes per centimeter, the superconducting leads 46 will not conduct significant heat from the first stage 34 to the second stage 36 of the cryocooler coldhead 14 so as to overheat the superconducting wire 28 of the magnet cartridge 20 and trigger a quench.

In operation, during a quench which might be caused by degraded cryocooler performance, in addition to the non-superconductive electric current flow in the non-superconducting components described in the previous paragraph, electric current additionally flows non-superconductively in the "superconducting" leads 46 and in the "superconducting" wire 28. The "superconducting" wire 28 typically is protected from burnout, due to resistive heating, by a parallel copper stabilizer wire. With the design current, the lead's length, and the lead's cross-sectional area chosen such that the design current times the lead's length divided by the lead's cross-sectional area is generally equal to 800 amperes per centimeter, the "superconducting" leads 46 will not be destroyed by resistive heating but rather have such heat conducted to the first stage 34 and/or second stage 36 of the cryocooler coldhead 14.

Prior to Applicants'invention, it was believed that superconducting leads would be destroyed (i.e., burned out) by resistive heating during a quench, and superconducting leads had been rejected for any commercial conduction-cooled superconducting magnet. It was Applicants who first discovered, in their research and development work, that a particular YBCO superconducting lead they designed survived the resistive heating of an unintentional twelve-hour quench. This unexpected discovery lead to an analytical investigation which resulted in establishing 800 amperes per centimeter for a DBCO or YBCO lead and 200 amperes per centimeter for a BSCCO lead as the optimum design criteria for the current density times the lead's length divided by the lead's cross-sectional area which enables a DBCO, YBCO, or BSCCO superconducting lead to be designed that will not itself precipitate a magnet quench (i.e., the superconducting lead of the invention does not conduct significant heat between the coldhead stages during the superconductive mode) and that would survive a lead quench from other causes (i.e., the superconducting lead of the invention does conduct the resistive heat buildup to the coldhead stages during a lead quench) and thus be acceptable for commercial applications such as in a cryocooler-cooled superconductive magnet for an MRI medical diagnostic system.

The foregoing description of a preferred embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

We claim:

1. A superconducting lead assembly for a superconducting magnet, said superconducting magnet having a design current between generally 50 and 250 amperes, said superconducting magnet cooled by a cryocooler coldhead having a first stage with a first stage design temperature of between generally 30 and 50 Kelvin and having a second stage with a second stage design temperature of between generally 8 and 30 Kelvin, said superconducting lead assembly comprising: a DBCO superconducting lead having a length and a generally constant cross-sectional area along said length; having a first end flexibly, dielectrically, and thermally connected to said first stage; having a second end flexibly, dielectrically, and thermally connected to said second stage; and wherein said design current times said length divided by said cross-sectional area is between generally 720 and 880 amperes per centimeter.

2. The superconducting lead assembly of claim 1, wherein said DBCO superconducting lead comprises a grain-aligned DBCO superconducting lead.

3. The superconducting lead assembly of claim 1, wherein said design current times said length divided by said cross-sectional area is generally 800 amperes per centimeter.

4. The superconducting lead assembly of claim 1, wherein said design current is generally 100 amperes and said length divided by said cross-sectional area is generally 8 inverse centimeters.

5. The superconducting lead assembly of claim 4, wherein said DBCO superconducting lead comprises a grain-aligned DBCO superconducting lead.

6. A superconducting lead assembly for a superconducting magnet, said superconducting magnet having a design current between generally 50 and 250 amperes, said superconducting magnet cooled by a cryocooler coldhead having a first stage with a first stage design temperature of between generally 30 and 50 Kelvin and having a second stage with a second stage design temperature of between generally 8 and 30 Kelvin, said superconducting lead assembly comprising: a YBCO superconducting lead having a length and a generally constant cross-sectional area along said length; having a first end flexibly, dielectrically, and thermally connected to said first stage; having a second end flexibly, dielectrically, and thermally connected to said second stage; and wherein said design current times said length divided by said cross-sectional area is between generally 720 and 880 amperes per centimeter.

7. The superconducting lead assembly of claim 6, wherein said YBCO superconducting lead comprises a grain-aligned YBCO superconducting lead.

8. The superconducting lead assembly of claim 6, wherein said design current times said length divided by said cross-sectional area is generally 800 amperes per centimeter.

9. The superconducting lead assembly of claim 6, wherein said design current is generally 100 amperes and said length divided by said cross-sectional area is generally 8 inverse centimeters.

10. The superconducting lead assembly of claim 9, wherein said YBCO superconducting lead comprises a grain-aligned YBCO superconducting lead.

11. A superconducting lead assembly for a superconducting magnet, said superconducting magnet having a design current between generally 50 and 250 amperes, said superconducting magnet cooled by a cryocooler coldhead having a first stage with a first stage design temperature of between generally 30 and 50 Kelvin and having a second stage with a second stage design temperature of between generally 8 and 30 Kelvin, said superconducting lead assembly comprising: a BSCCO superconducting lead having a length and a generally constant cross-sectional area along said length; having a first end flexibly, dielectrically, and thermally connected to said first stage; having a second end flexibly, dielectrically, and thermally connected to said second stage; and wherein said design current times said length divided by said cross-sectional area is between generally 180 and 220 amperes per centimeter.

12. The superconducting lead assembly of claim 11, wherein said BSCCO superconducting lead comprises a grain-aligned BSCCO superconducting lead.

13. The superconducting lead assembly of claim 11, wherein said design current times said length divided by said cross-sectional area is generally 200 amperes per centimeter.

14. The superconducting lead assembly of claim 11, wherein said design current is generally 100 amperes and said length divided by said cross-sectional area is generally 2 inverse centimeters.

15. The superconducting lead assembly of claim 14, wherein said BSCCO superconducting lead comprises a grain-aligned BSCCO superconducting lead.

* * * * *